US010677489B2

(12) United States Patent
Puranen et al.

(10) Patent No.: US 10,677,489 B2
(45) Date of Patent: Jun. 9, 2020

(54) INTELLIGENT BYPASS DAMPER OPERATION IN AN HVAC SYSTEM WITH ZONES

(71) Applicant: Rheem Manufacturing Company, Atlanta, GA (US)

(72) Inventors: Christopher M. Puranen, Montgomery, AL (US); Stephen Maciulewicz, Montgomery, AL (US)

(73) Assignee: Rheem Manufacturing Company, Atlanta, GA (US)

( * ) Notice: Subject to any disclaimer, the term of this patent is extended or adjusted under 35 U.S.C. 154(b) by 149 days.

(21) Appl. No.: 15/850,619

(22) Filed: Dec. 21, 2017

(65) Prior Publication Data

US 2019/0195528 A1 Jun. 27, 2019

(51) Int. Cl.

| | |
|---|---|
| ***F24F 11/74*** | (2018.01) |
| ***F24F 11/81*** | (2018.01) |
| *F24F 140/40* | (2018.01) |
| *F24F 110/40* | (2018.01) |
| *F24F 130/40* | (2018.01) |
| *F24F 110/10* | (2018.01) |

(52) U.S. Cl.

CPC ..... *F24F 11/74* (2018.01); *F24F 11/81* (2018.01); *F24F 2110/10* (2018.01); *F24F 2110/40* (2018.01); *F24F 2130/40* (2018.01); *F24F 2140/40* (2018.01)

(58) Field of Classification Search

CPC ..... F24F 11/81; F24F 11/74; F24F 11/745; F24F 11/75; F24F 11/76; F24F 11/30; F24F 11/70; G05D 23/193; G05D 23/1931; G05D 23/1932; G05D 23/1934

See application file for complete search history.

(56) References Cited

U.S. PATENT DOCUMENTS 4,732,318 A * 3/1988 Osheroff ..... F24F 3/0442 236/49.3
4,829,447 A * 5/1989 Parker ..... F24F 11/0009 165/205
5,249,596 A * 10/1993 Hickenlooper ..... F24F 13/1426 137/334
5,305,953 A * 4/1994 Rayburn ..... F24D 19/1084 236/49.3
6,298,912 B1 * 10/2001 Rayburn ..... F24F 11/76 165/249

(Continued)

*Primary Examiner* — Nelson J Nieves
(74) *Attorney, Agent, or Firm* — Troutman Sanders LLP

(57) ABSTRACT

An HVAC system includes at least one zone comprising a zone damper and a bypass comprising a bypass damper associated with a virtual zone. When an airflow of conditioned air to the at least one zone exceeds a maximum airflow value for the at least one zone and/or when other airflow reduction techniques have been exhausted, a system controller of the HVAC system controls the bypass damper to incrementally bypass a portion of conditioned air to the virtual zone. The portion of the conditioned air that is bypassed is a minimum amount of the conditioned air that is needed to reduce the airflow of the conditioned air below the maximum airflow value and keep the HVAC system running. Further, the system controller closes the bypass damper when a temperature of the portion of the conditioned air exceeds a threshold temperature value.

10 Claims, 9 Drawing Sheets

(56) References Cited

U.S. PATENT DOCUMENTS

| | | | | |
|---|---|---|---|---|
| 6,997,390 | B2 * | 2/2006 | Alles | F24F 3/0442 236/49.4 |
| 7,017,827 | B2 | 3/2006 | Shah et al. | |
| 7,178,545 | B2 * | 2/2007 | Zelczer | G05D 7/03 137/115.07 |
| 7,891,573 | B2 | 2/2011 | Finkam et al. | |
| 8,915,295 | B2 * | 12/2014 | Norrell | F24F 13/1426 165/284 |
| 9,519,320 | B2 * | 12/2016 | Montero | G05D 7/0623 |
| 2005/0156050 | A1 * | 7/2005 | Shah | F24F 3/0442 236/1 B |
| 2017/0089628 | A1 * | 3/2017 | Jang | F24F 1/0011 |
| 2018/0112886 | A1 * | 4/2018 | Boody | F24F 11/81 |
| 2018/0224145 | A1 * | 8/2018 | Tajima | B01D 53/26 |
| 2018/0274802 | A1 * | 9/2018 | Nishimura | F24F 3/14 |

* cited by examiner

INTELLIGENT BYPASS DAMPER OPERATION IN AN HVAC SYSTEM WITH ZONES

TECHNICAL FIELD

The present disclosure relates generally to temperature control systems, and more particularly to an intelligent bypass damper operation in a heating, ventilating, and air-conditioning (HVAC) zoned system.

BACKGROUND

Multi-zone HVAC systems (hereinafter 'HVAC zoned systems') include one or more components to condition air that enters the system and drive the conditioned air through supply ducts to multiple zones within a building. Each supply duct includes zone dampers that may be adjusted to control a flow of the conditioned air into each zone to achieve a desired temperature and airflow within the zone. When a zone reaches a desired conditioned state, typically, the zone dampers associated with the zone are closed. Since a fixed amount of air is delivered by the air handler of the HVAC system under most operational conditions, when the zone dampers of one zone are closed, additional air is driven through the remaining zones that have open zone dampers which causes static pressure to build up in the remaining zones and affect a balance of airflow and pressure across the HVAC system. The increased amount of air that is driven through any one zone may cause the zone to be over-conditioned and increase a noise level in the zone to undesirable levels. The term 'static pressure' as used herein refers to an external static pressure of the HVAC system.

One conventional solution to relieve the static pressure and reduce the airflow noise includes providing a bypass system which includes a bypass damper that allows the excess or additional air to be returned to the return duct and back to the temperature changing elements (heating or cooling coils) of the HVAC system via a bypass duct. However, conventional bypass dampers that are used in the bypass system do not provide any means for precisely controlling the amount of conditioned air that is returned to the return duct and the temperature changing elements of the HVAC system. The inability of the conventional bypass dampers to provide a precise control of the amount of conditioned air that is returned to the return duct may negatively affect the efficiency of the HVAC system and cause additional problems. For example, in a cooling cycle, cold air that is returned to the return duct via the bypass damper of the bypass system may reduce the temperature of the air that reaches the evaporator coil, thereby making the evaporator coil colder and reducing its efficiency. Further in said example, since the conventional bypass dampers do not provide precise control of the conditioned air that is returned to the return duct, sometimes a large amount of cold air may be returned to the return duct which may reduce to the temperature of the air that reaches the evaporator coil to an extent that it could freeze the evaporator coil.

One conventional bypass damper is a mechanical bypass damper that utilizes a weighted arm with a spring and typically includes two damper positions, i.e., a fully open position and a fully closed position. Other conventional bypass dampers, such as modulating bypass dampers that can be incrementally closed to provide control over the amount of conditioned air that is returned to the return duct do exist. However, a flow of conditioned air with a change in damper positions of said modulating bypass dampers exhibit a nonlinear behavior, thereby affecting an ability to accurately determine the amount of air that flows through the bypass damper at each damper position of the bypass damper.

Other solutions to relieve the static pressure and reduce the airflow noise without using bypass systems do exist. One such solution includes smart HVAC zoned systems, such as a multi-stage or modulating HVAC system that does not include a bypass. Instead, the smart HVAC systems use alternate techniques to relieve the static pressure and reduce the airflow noise in the zones where additional air is delivered. Such alternate techniques may include reducing the airflow using a variable speed blower, reducing equipment capacity, dumping into set back zones, etc. However, once the attempts to reduce the airflow noise using the alternate techniques have been exhausted and the airflow noise is still above an undesirable level, then, the smart HVAC system shuts down which in turn may leave one or more zones under-conditioned. For systems that are prone to noise issues, e.g., systems with many zones, or small ductwork, etc., one or more zones may remain under-conditioned regularly.

Therefore, improvements to HVAC systems with zones are described herein. It is noted that this background information is provided to reveal information believed by the applicant to be of possible relevance to the present disclosure. No admission is necessarily intended, nor should be construed, that any of the preceding information constitutes prior art against the present disclosure.

SUMMARY

In one aspect, the present disclosure is related to an HVAC system. The HVAC system includes an air handler that is configured to deliver conditioned air to at least one zone via a supply duct. The supply duct is coupled to a plenum. Further, the HVAC system includes a zone damper that is disposed in the supply duct and configured to control an airflow of the conditioned air to the at least one zone. Furthermore, the HVAC system includes a bypass damper that is associated with a virtual zone and disposed in a bypass duct that connects the plenum to a return duct, and a system controller that is coupled to the air handler, the zone damper, and the bypass zone damper. The system controller is configured to: maintain a set point temperature and an actual temperature of the virtual zone such that the virtual zone will be used as a dump zone. Further, the system controller is configured to control the bypass damper to incrementally bypass a portion of the conditioned air to the virtual zone when the airflow of the conditioned air to the at least one zone exceeds a maximum airflow value for the at least one zone. The portion of the conditioned air that is bypassed is a minimum amount of the conditioned air that is needed to reduce the airflow of the conditioned air to the at least one zone below the maximum airflow value and keep the HVAC system running. Furthermore, the system controller is configured to close the bypass damper when a temperature of the portion of the conditioned air that is bypassed from the plenum exceeds a first threshold temperature.

In another aspect, the present disclosure is related to a system controller of an HVAC system. The HVAC system includes a processor, and a memory comprising program instructions that when executed by the processor cause the processor to determine a relative size of a virtual zone that is associated with a bypass damper of the HVAC system. The relative size of the virtual zone is representative of a share of a total system airflow that is delivered to the virtual zone when the bypass damper is in a fully open position. The program instructions further cause the processor to generate corrected positions for intermediate damper positions of the bypass damper between the fully open position and a fully closed position to obtain a linear behavior of airflow through the bypass damper. Furthermore, the program instructions cause the processor to adjust a damper position of the bypass damper to one of a plurality of corrected positions to bypass a portion of the conditioned air to the virtual zone when the airflow of conditioned air to at least one zone of the HVAC system exceeds a maximum airflow value for the at least one zone. The portion of the conditioned air that is bypassed is a minimum amount of the conditioned air that is needed to reduce the airflow of the conditioned air to the at least one zone below the maximum airflow value and keep the HVAC system running. The one of the plurality of corrected damper positions is selected based on the minimum amount of the conditioned air that is to be bypassed to the virtual zone and the relative size of the virtual zone. Additionally, the program instructions cause the processor to close the bypass damper when a temperature of the portion of the conditioned air that is bypassed exceeds a first threshold temperature.

These and other aspects, objects, features, and embodiments, will be apparent from the following description and the appended claims.

BRIEF DESCRIPTION OF THE FIGURES

The foregoing and other features and aspects of the present disclosure are best understood with reference to the following description of certain example embodiments, when read in conjunction with the accompanying drawings, wherein.

Figure 1:
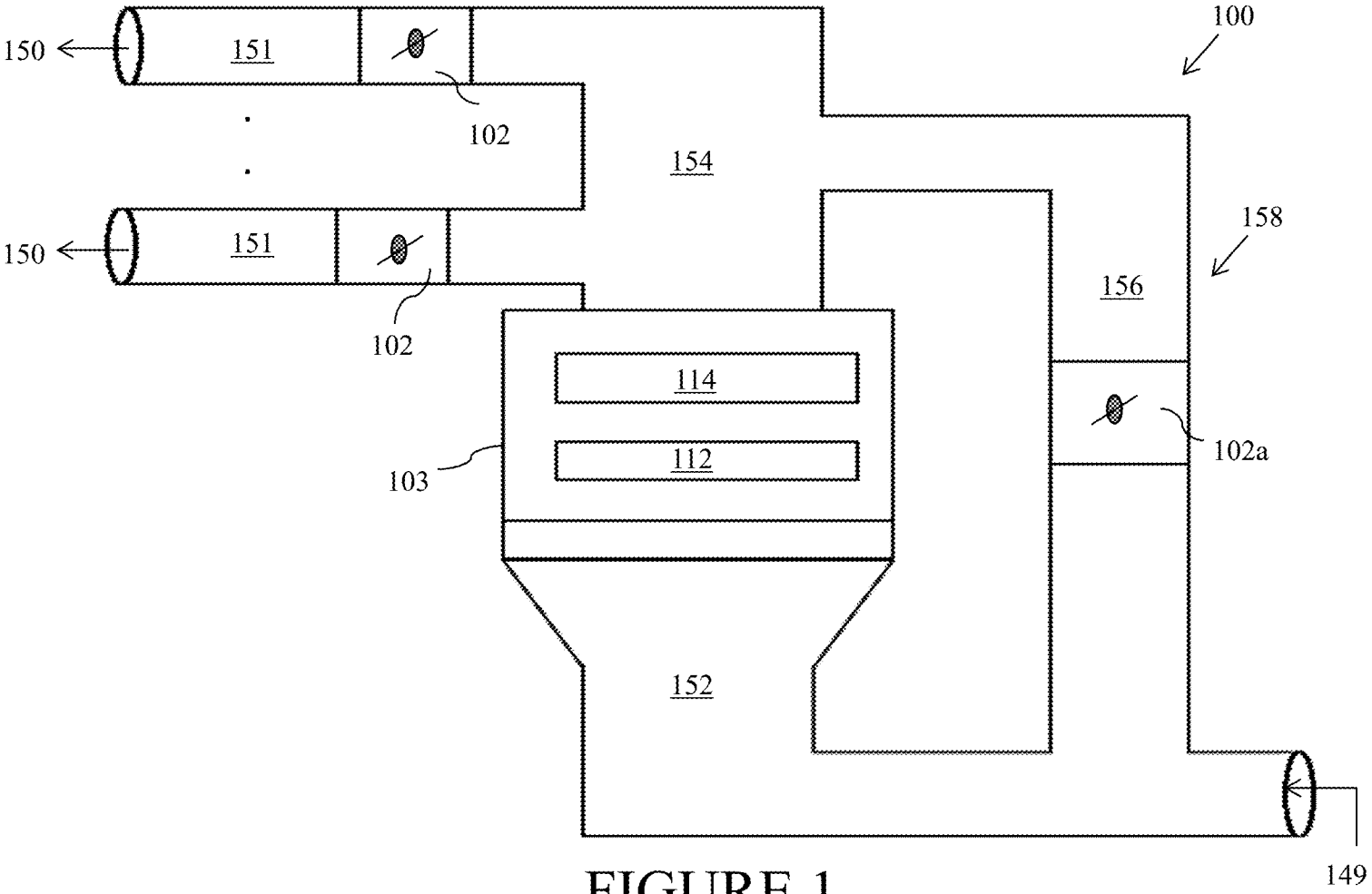
FIG. 1 is a schematic diagram of an example smart HVAC system with a bypass damper, in accordance with example embodiments of the present disclosure.

The drawings illustrate only example embodiments of the present disclosure and are therefore not to be considered limiting of its scope, as the present disclosure may admit to other equally effective embodiments. The elements and features shown in the drawings are not necessarily to scale, emphasis instead being placed upon clearly illustrating the principles of the example embodiments. Additionally, certain dimensions or positions may be exaggerated to help visually convey such principles.

DETAILED DESCRIPTION OF EXAMPLE EMBODIMENTS

The present disclosure describes the addition of an intelligent bypass damper operation to a smart HVAC zoned system. The term 'smart HVAC zoned system' as used herein may refer to any appropriate HVAC zoned system that does not use a bypass and instead uses alternate techniques such as reducing the airflow using a variable speed blower, reducing equipment capacity, dumping into set back zones, etc., to relieve static pressure and reduce airflow noise in the HVAC zoned system. The smart HVAC zoned system may also be referred to as a bypass-less HVAC zoned system.

A smart HVAC zoned system (hereinafter 'HVAC system') of the present disclosure may be provided with a bypass damper, such as a modulating bypass damper. The bypass damper may be treated as a virtual zone in the HVAC system, and accordingly, a relative zone size of the virtual zone may be determined. The term 'virtual zone' as used herein may refer to a zone of the HVAC system that does not have a thermal load associated therewith. In the example embodiment of the present disclosure, the virtual zone associated with the bypass damper may refer to a space to which the conditioned air is returned from the supply duct, e.g., the return duct space and/or a portion of the air handler where the conditioned air from the supply duct reaches the temperature control elements.

Each zone damper of the HVAC system including the bypass damper is incrementally closed from a fully open position to a fully closed position and static pressure measurements are recorded with each change in damper position. Then, using a mathematical model that is derived from the second fan law, a correction is calculated for each damper position of each zone damper based on the static pressure measurements to provide corrected damper positions at which the airflow through the zone damper exhibits a linear behavior. The corrected damper positions are stored in a memory associated with the HVAC system for use during an operational phase of the HVAC system. The term 'operational phase' as used herein may refer to a phase in which the HVAC system operates to meet a thermal load demand of each zone. The term 'operational phase' may also be referred to as a demand cycle.

During an operational phase, if a zone is violating its maximum airflow limit, various steps will be used to reduce airflow, such as reducing a total system airflow of the HVAC system by controlling the variable speed blower, adjusting setback zones to dump excess air into the setback zones, and/or staging down a capacity of the HVAC system. When the various steps have been exhausted and the airflow to the zone is still violating the maximum airflow limit of the zone, typical smart HVAC zoned systems shut down, thereby leaving one or more zones under-conditioned.

However, in the HVAC system of the present disclosure, when the various steps have been exhausted and the airflow to the zone is still violating the maximum airflow limit of the zone, the bypass will be used as another zone similar to a setback zone to dump the conditioned air for relieving pressure and reducing airflow noise in the zone while still meeting a minimum airflow requirement to keep the HVAC system running to condition any remaining zone. In other words, when the various steps have been exhausted and the airflow to the zone is still violating the maximum airflow limit of the zone, the HVAC system of the present disclosure bypasses precise amounts of the conditioned air to the virtual zone using the damper positions (corrected damper position) of the zone damper that have been corrected to exhibit a linear behavior of airflow with a change in damper positions of the zone damper. The precise amount of air that is bypassed into the virtual zone is only a minimum amount that is needed to allow or keep the HVAC system running, instead of shutting down. The term 'bypassed' or 'bypassing' as used herein may refer to a process of returning a portion of the conditioned air from the supply duct to the return duct and/or back to the temperature changing elements of the HVAC system.

A precise control of the amount of conditioned air that is bypassed into the virtual zone further allows the HVAC system to precisely control a change in temperature of the air that reaches the temperature control elements of the HVAC system to a point where it is still safe to operate while alleviating pressure and reducing airflow noise in the HVAC system. Further, to prevent the conditioned air that is bypassed to the virtual zone from negatively impacting the temperature control elements, the HVAC system monitors the temperature of the conditioned air that is bypassed and stops a bypass operation by closing the bypass damper when the temperature of the conditioned air that is bypassed exceeds a first threshold temperature. The bypass operation is resumed when the temperature of the conditioned air that is bypassed falls below a second threshold temperature that is lower than the first threshold temperature.

Example embodiments of the HVAC system and method of the present disclosure will be described more fully hereinafter with reference to the accompanying drawings that describe representative embodiments of the present technology. If a component of a figure is described but not expressly shown or labeled in that figure, the label used for a corresponding component in another figure can be inferred to that component. Conversely, if a component in a figure is labeled but not described, the description for such component can be substantially the same as the description for a corresponding component in another figure. Further, a statement that a particular embodiment (e.g., as shown in a figure herein) does not have a particular feature or component does not mean, unless expressly stated, that such embodiment is not capable of having such feature or component. For example, for purposes of present or future claims herein, a feature or component that is described as not being included in an example embodiment shown in one or more particular drawings is capable of being included in one or more claims that correspond to such one or more particular drawings herein.

The technology of the HVAC system and method of the present disclosure may be embodied in many different forms and should not be construed as limited to the embodiments set forth herein; rather, these embodiments are provided so that this disclosure will be thorough and complete, and will fully convey the scope of the technology to those appropriately skilled in the art. Further, example embodiments of the present disclosure can be located in any type of environment (e.g., warehouse, attic, garage, storage, mechanical room, basement) for any type (e.g., commercial, residential, industrial) of user.

Terms such as "first", "second", "third", and "within", etc., are used merely to distinguish one component (or part of a component or state of a component) from another. Such terms are not meant to denote a preference or a particular orientation, and are not meant to limit embodiments of HVAC systems and methods of the present disclosure. In the following detailed description of the example embodiments, numerous specific details are set forth in order to provide a more thorough understanding of the invention. However, it will be apparent to one of ordinary skill in the art that the invention may be practiced without these specific details. In other instances, well-known features have not been described in detail to avoid unnecessarily complicating the description.

Turning now to the figures, example embodiments of an example smart HVAC zoned system with a bypass damper will be described in connection with FIGS. 1-7. In particular, the example smart HVAC zoned system and a control system of the smart HVAC zoned system will be described in connection with FIGS. 1-2; example operations of the smart HVAC zoned system and the control system will be described in connection with FIGS. 3-6; and an example system controller of the control system will be described in in connection with FIG. 7.

Figure 2:
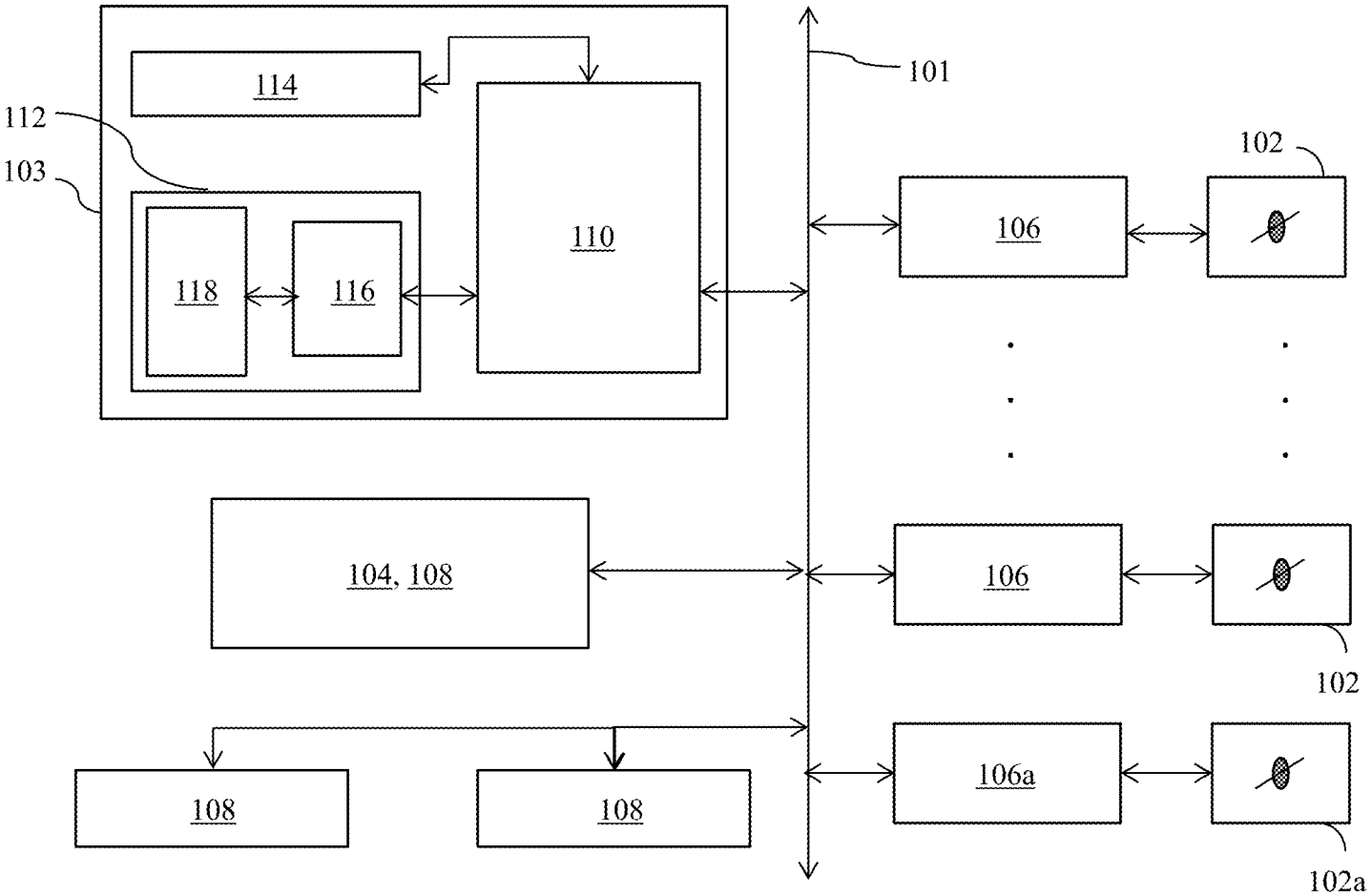
FIG. 2 is an example control system of the smart HVAC system of FIG. 1, in accordance with example embodiments of the present disclosure.

Referring to FIGS. 1-2, an example smart HVAC zoned system 100 (hereinafter 'HVAC system') may include an air handler 103 that takes ambient air 149 from a return duct 152, conditions the ambient air 149 using temperature changing elements 114, and drives the conditioned air into a plenum 154, and a plurality of supply ducts 151 associated with distinct zones 150 in a building. Each supply duct 151 may include a zone damper 102 that may be controlled by a system controller 104 to restrict or allow flow of the conditioned air into each zone 150 to achieve a desired temperature. In particular, each zone may include a zone panel 106 that may be coupled to the system controller 104 and the respective zone damper 102. In one example embodiment, the zone panel 106 may be a simple input/output device that may be configured to adjust the damper position of the zone damper 102 based on control signals received from the system controller 104. However, in other example embodiments, the zone panel 106 may be an intelligent device that may be configured to process information, make decisions, and perform control operations.

Conventional smart HVAC zoned systems do not include a bypass because of the inability of said conventional systems to precisely control the amount of conditioned air that is bypassed. However, since the dampers of the HVAC system 100 are corrected to exhibit a linear relationship of airflow with a change in damper positions and thereby provide a precise control of the amount of conditioned air passing through the dampers, the HVAC system 100 of the present disclosure includes a bypass 158. The process of correcting the dampers will be described further in association with FIGS. 3 and 5.

The bypass 158 includes a bypass damper **102*a* that is installed in the HVAC system 100. The bypass damper 102*a* is disposed in a bypass duct 156 that connects the plenum 154 to the return duct 152. The bypass damper 102*a* may be controlled by a system controller 104 to return a portion of the conditioned air (e.g., excess air supplied to a zone) from the plenum 154 and/or supply ducts 150 to the return duct 152 and back to the temperature control elements 114 of the air handler 103. The conditioned air may be bypassed by the bypass damper 102*a* to relieve a static pressure that builds up in the HVAC system 100 and to reduce an airflow noise in one or more zones 150 of the HVAC resulting from too much air being supplied to said one or more zones 150 responsive to a closing of zone dampers 102 in other zones 150. Similar to the zone dampers 102, the bypass damper 102*a* may be coupled to a zone panel 106*a* that may be configured to adjust the damper position of the bypass damper 102***a* based on control signals received from the system controller 104.

The zone dampers 102 and the bypass damper 102*a* may be modulating dampers that have one or more damper blades that may be incrementally closed. In other words, the dampers (102, 102*a*) may have several intermediate positions between a fully open position and a fully closed position. In the example embodiment of the present disclosure, each damper (102, 102*a*) of the HVAC system 100 may include six intermediate angular positions (herein 'intermediate positions') between the fully open position and a fully closed position. That is, damper (102, 102*a*) may have a total of eight positions, where the first position may be a fully open position and the eighth position may be a fully closed position or vice-versa. However, one of skill in the art can understand and appreciate that in other example embodiments, the dampers (102, 102*a*) of the HVAC system 100 may have fewer or more incremental positions between the fully open position and the fully closed position without departing from a broader scope of the present disclosure. For example, the bypass damper 102*a* may have sixteen positions while the zone dampers 102 have eight positions. Further, even though FIGS. 1 and 2 illustrate each zone 150 having a single zone damper 102, one of skill in the art can understand and appreciate that in other example embodiments, each zone 150 may have a plurality of zone dampers 102 that are coupled together and configured to operate in concert to provide the necessary airflow to the respective zone. Similarly, the bypass 158 may include a plurality of bypass dampers 102*a* that are coupled together and configured to operate in concert to return a precise amount of conditioned air to the return duct 152.

As illustrated in FIG. 2, the system controller 104 may be coupled to the zone panels 106 of the different zones 150, the zone panel 106*a* associated with the bypass damper 102*a*, the thermostats 108 associated with each zone 150, and the air handler 103 through a data communication bus 101 of a communication system of the HVAC system 100, such as Rheem EcoNet™. In particular, with respect to the air handler 103, the system controller 104 may be coupled to an air handler controller 110 that transmits air handler data to the system controller 104 and receives data from the system controller 104. The air handler controller 110 may be configured to control a functioning of the air handler 103 in general, and/or a functioning of the different components of the air handler 103, such as, the blower assembly 112 and the temperature control elements 114 (heating and/or cooling coils). The blower assembly 112 may include a motor 116 that is coupled to and configured to be controlled by the air handler controller 110 based on operational requests received from the system controller 104 and/or the thermostats 108. The motor 116 is configured to control the blades of a fan 118 to move air through the supply ducts 151 and into the zones 150 of the HVAC system 100 based on the operational requests. Preferably, the motor 116 may be an electronically commutated motor (ECM) and the blower assembly 112 may be a variable speed blower assembly that can vary the total system airflow of the HVAC system 100.

In one example embodiment, the system controller 104 may be any one of the thermostats 108 of the HVAC system. For example, a thermostat associated with a first zone may be configured to operate as the system controller 104. Alternatively, in another example, a thermostat associated with the main or largest zone may be configured to operate as the system controller 104. In other example embodiments, the system controller 104 may be a dedicated control device that is distinct from and communicatively coupled to the thermostats 108 of the different zones.

In either case, the system controller 104 may be configured to receive information of all the zones from the respective thermostats 108 and control the zone dampers 102 of each zone and the bypass damper 102*a* of the bypass 158 through the respective zone panels (106, 106*a*) to adjust an airflow to the respective zones and to return conditioned air to the return duct 152 when the airflow in any zone exceeds a threshold airflow limit, respectively. Further, the system controller 104 is configured to calculate corrections for the intermediate positions of the dampers (102, 102*a*) of the HVAC system 100 to exhibit linear behavior of airflow with a change in the damper positions of the dampers (102, 102*a*). Furthermore, the system controller 104 is configured to determine a size of each zone 150 of the HVAC system 100, including a virtual zone associated with the bypass damper 102*a*. A zone size may be representative of a duct size of the zone.

One of ordinary skill in the art can understand and appreciate that in addition to the components described above, the HVAC system 100 may include many other additional components such as filters, a condensing unit, etc. However, said additional components are not described herein to avoid obscuring the features that are associated with an intelligent bypass damper operation to bypass air in the HVAC system 100.

Example operations of the system controller 104 of the HVAC system 100 associated with the intelligent bypass damper operation to bypass air in the HVAC system 100 will be described below in greater detail in association with FIGS. 3-6.

Although specific operations are disclosed in the flowcharts illustrated in FIGS. 3-6, such operations are only non-limiting examples. That is, embodiments of the present invention are well suited to performing various other operations or variations of the operations recited in the flowcharts. It is appreciated that the operations in the flowcharts illustrated in FIGS. 3-6 may be performed in an order different than presented, and that not all of the operations in the flowcharts may be performed.

All, or a portion of, the embodiments described by the flowcharts illustrated in FIGS. 3-6 can be implemented using computer-readable and computer-executable instructions which reside, for example, in computer-usable media of a computer system, a memory of the system controller 104, or like device. As described above, certain processes and operations of the present invention are realized, in one embodiment, as a series of instructions (e.g., software programs) that reside within computer readable memory of a computer system or a memory associated with the system controller 104 and are executed by the processor of the computer system or the system controller 104. When executed, the instructions cause the computer system or the system controller 104 to implement the functionality of the present invention as described below.

Figure 3:
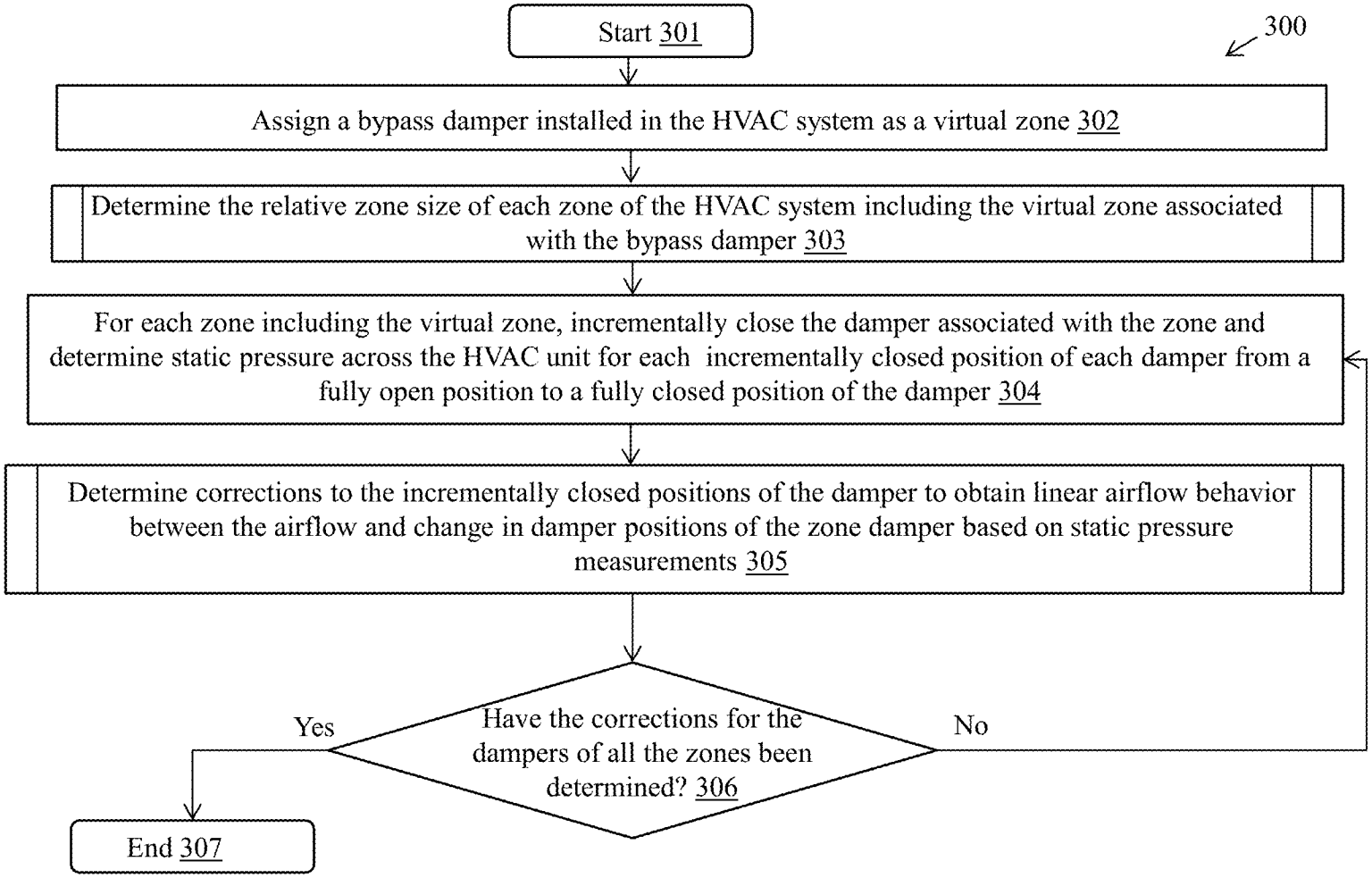
FIG. 3 is a flowchart that illustrates an example operation of the HVAC system of FIG. 1 during an initial set up phase, in accordance with example embodiments of the present disclosure.

Turning to FIG. 3, operation 300 of the system controller 104 may be executed during an initial set up phase of the HVAC system 100 and may or may not be repeated periodically thereafter. In other words, operation 300 may be executed by the system controller 104 shortly after the HVAC system 100 in installed.

The operation 300 starts at step 301 and proceeds to step 302 where the system controller 104 assigns or treats the bypass damper 102*a* as a virtual zone of the HVAC system 100. The virtual zone may include a space to which the conditioned air is returned by the bypass damper 102*a*, e.g., a portion of the return duct 152 and/or the air handler 103. The virtual zone may not include a dedicated thermostat 108. Instead, the system controller 104 is used to control the set point temperatures and actual temperatures associated with the virtual zone based on data from thermostats 108 associated with the other zones 150 and how the virtual zone is to be used during an operational phase (demand cycle). For example, if the virtual zone is to be used as a setback zone for dumping excess air, the set point temperatures and actual temperatures associated with the virtual zone must be adjusted to ensure that the virtual zone will be used as a dump zone. Example adjustments of the set point temperatures and actual temperatures of the virtual zone will be described further in association with FIG. 6. In some embodiments, the adjustment of the set point and actual temperatures of the virtual zone may be performed during the operational phase rather than in the initial set up phase.

In some embodiments, step 302 may be omitted or may be combined with step 303 where the system controller 104 determines the relative size of each zone 150 of the HVAC system 100, including the virtual zone associated with the bypass damper 102*a*. Determining the relative size of each zone 150 and the virtual zone allows the system controller 104 to further determine a share of the total system airflow that each zone and the virtual zone may receive when the zone dampers of the HVAC system are fully open. Determining the size of each zone will be described below in greater detail in association with FIG. 4.

Figure 4:
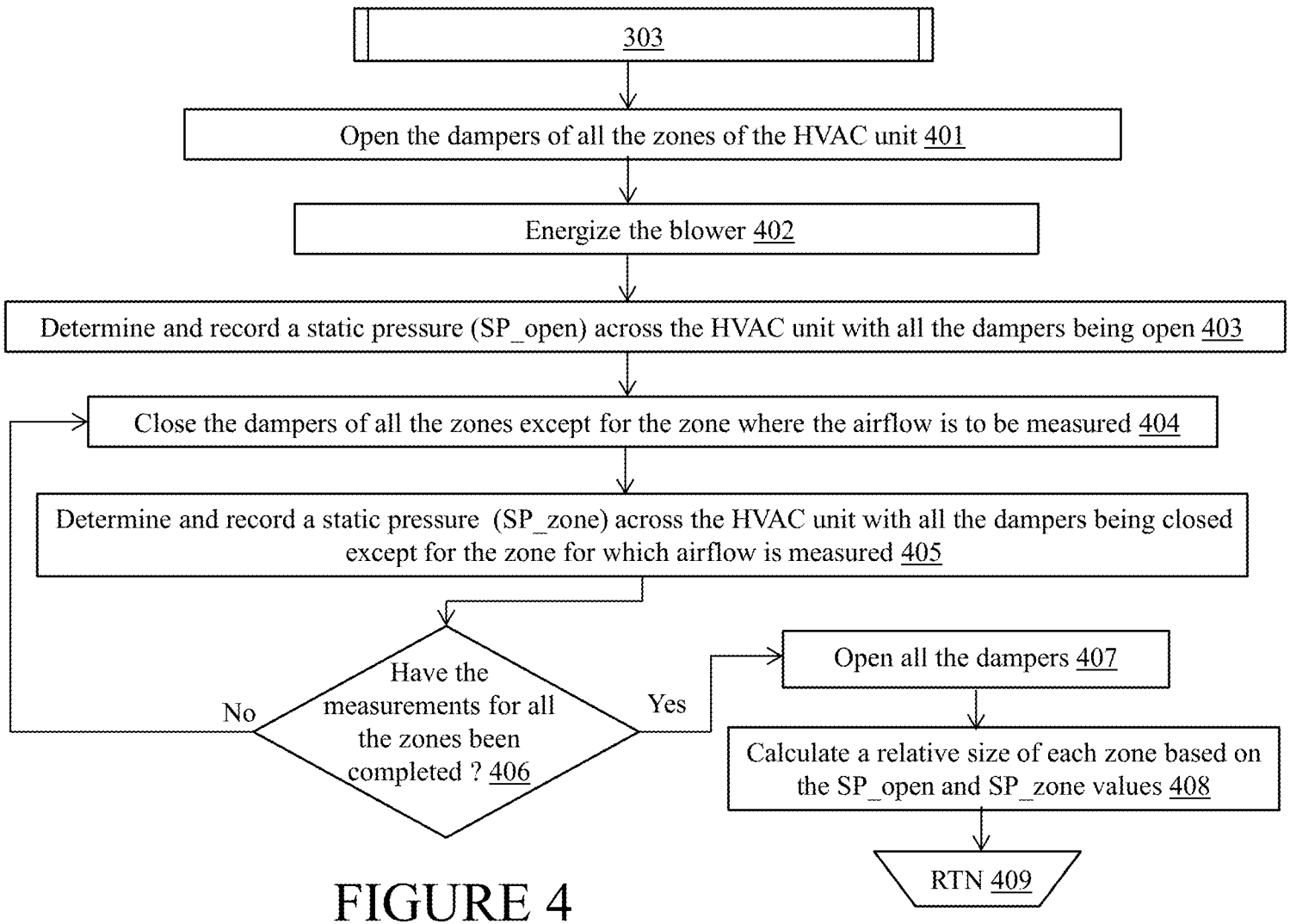
FIG. 4 is a flowchart that illustrates an example method of sizing the zones of the HVAC system of FIG. 1, in accordance with example embodiments of the present disclosure.

Turning to FIG. 4, step 303 associated with determining the size of each zone of the HVAC system 100 begins at step 401 where the system controller 104 turns off the temperature control elements 114 of the HVAC system 100 and opens all the dampers (102, 102*a*) of the HVAC system 100. Then, in step 402, the system controller 104 instructs the air handler controller 110 to energize the blower assembly 112 and deliver a fixed total system airflow through the HVAC system 100. Responsively, in step 403, the system controller 104 records a static pressure (SP_open) across the HVAC system 100 based on the motor speed of the motor 116 that controls the fan 118 of the blower assembly 112 when all the dampers (102, 102*a*) of HVAC system 100 are open.

Using the motor speed, the static pressure may be obtained from a table that provides static pressure values for different motor speeds (rpm) and the resulting airflow (cfm) values. The table may be developed and stored in a memory of the system controller 104 at a factory, i.e., prior to installation of the HVAC system 100. For example, the table is developed by subjecting the HVAC system 100 to extensive empirical testing at the factory for determining the static pressure across the HVAC system 100 for different motor speeds (rpm) and the resulting airflow (cfm) values. The process of obtaining the static pressure across the HVAC system 100 allows a sensor free operation which may be beneficial. However, in other example embodiments, sensors may be used to determine the static pressure during step 303.

Once the static pressure (SP_open) across the HVAC system 100 is determined when all the dampers (102, 102*a*) are open, in steps 404-407, the system controller 104: (a) closes all the dampers (102, 102*a*) except zone damper 102 of a first zone 150, and (b) instructs the air handler controller 110 to deliver the same fixed airflow as before. Responsively, the system controller 104 records a static pressure (SP_zone1) across the HVAC system 100 based on the motor speed of the motor 116 that controls the fan 118 of the blower assembly 112 when all the dampers (102, 102*a*) except the zone damper 102 of the first zone is opened. In a similar manner, sequentially, dampers (102, 102*a*) for each zone 150 and the virtual zone in the HVAC system 100 are opened while all other dampers are closed. In each step of said sequence, the air handler controller 110 is instructed to deliver the same fixed airflow, and the resulting static pressure (SP_zone(i)) across the HVAC system 100 for each zone 150 and (SP_virtual zone) of the virtual zone that is open by itself is recorded.

Finally, when the static pressure (SP_zone(i)) across the HVAC system 100 for each zone and and (SP_virtual zone) for the virtual zone that is open by itself is recorded, in operations 407-408, the system controller 104 re-opens all the dampers (102, 102*a*) and calculates the relative size of each zone of the HVAC system 100, including the virtual zone, based on the recorded static pressure values, i.e., SP_open, SP_zone(i), and SP_virtual zone by using one or more of the fan laws (e.g., second fan law) and/or derivatives of the fan laws. In other example embodiments, any other appropriate mathematical models that relate the static pressure to a duct size may be used to calculate the relative size of each zone without departing from a broader scope of the present disclosure. One of skill in the art would understand how to configure the system controller 104 to compute the relative zone sizes based on the recorded static pressures and using the fan laws or derivatives of the fan laws. Accordingly, the calculation of the relative zone sizes of the HVAC system 100 will not be described here in greater detail for the sake of brevity. Once the relative zone sizes of all the zones including the virtual zone are calculated, the system controller 104 returns to step 304 of operation 300.

In some example embodiments, when the static pressure (SP_zone(i)) across the HVAC system 100 for each zone and SP_virtual zone for the virtual zone has been recorded, prior to calculating the relative zone sizes and returning to step 304 of operation 300, the system controller 104 may close all the dampers (102, 102*a*) of all the zones and record a static pressure (SP closed) across the HVAC system 100 for the same fixed airflow from the blower assembly 112 to detect and determine a size of any leaks in the HVAC system 100. Further, the size of the leak may be factored into the calculation of the zone sizes of the HVAC system 100. Hereinafter the reader is to understand that the term 'each zone' includes both the zones 150 associated with the zone dampers 102 and the virtual zone associated with the bypass damper 102*a*.

Referring back to FIG. 3, in step 304, for each zone, the system controller 104 incrementally closes the corresponding damper (102 or 102*a*) and records a static pressure (SP_position(i)) across the HVAC system 100 for each incrementally closed position of the damper (102 or 102*a*). For example, for a zone 150, the damper 102 is incrementally closed; and for a virtual zone, the bypass damper 102*a* is incrementally closed. Once the damper (102, 102*a*) of a respective zone reaches a fully closed position, the system controller 104 records a static pressure (SP_zone closed) across the HVAC system 100. Then, the damper (102, 102*a*) of the respective zone is re-opened.

Once the static pressure across the HVAC system 100 is recorded for each intermediate position and the closed position of the damper (102, 102*a*), in step 305, based on the recorded static pressure values, the system controller 104 determines a correction for each intermediate position of the damper (102, 102*a*) to provide a linear behavior of airflow with each change in damper position of the damper (102, 102*a*). Step 305 involving determining the correction for each intermediate position of the damper (102, 102*a*) will be described below in greater detail in association with FIG. 5.

Figure 5:
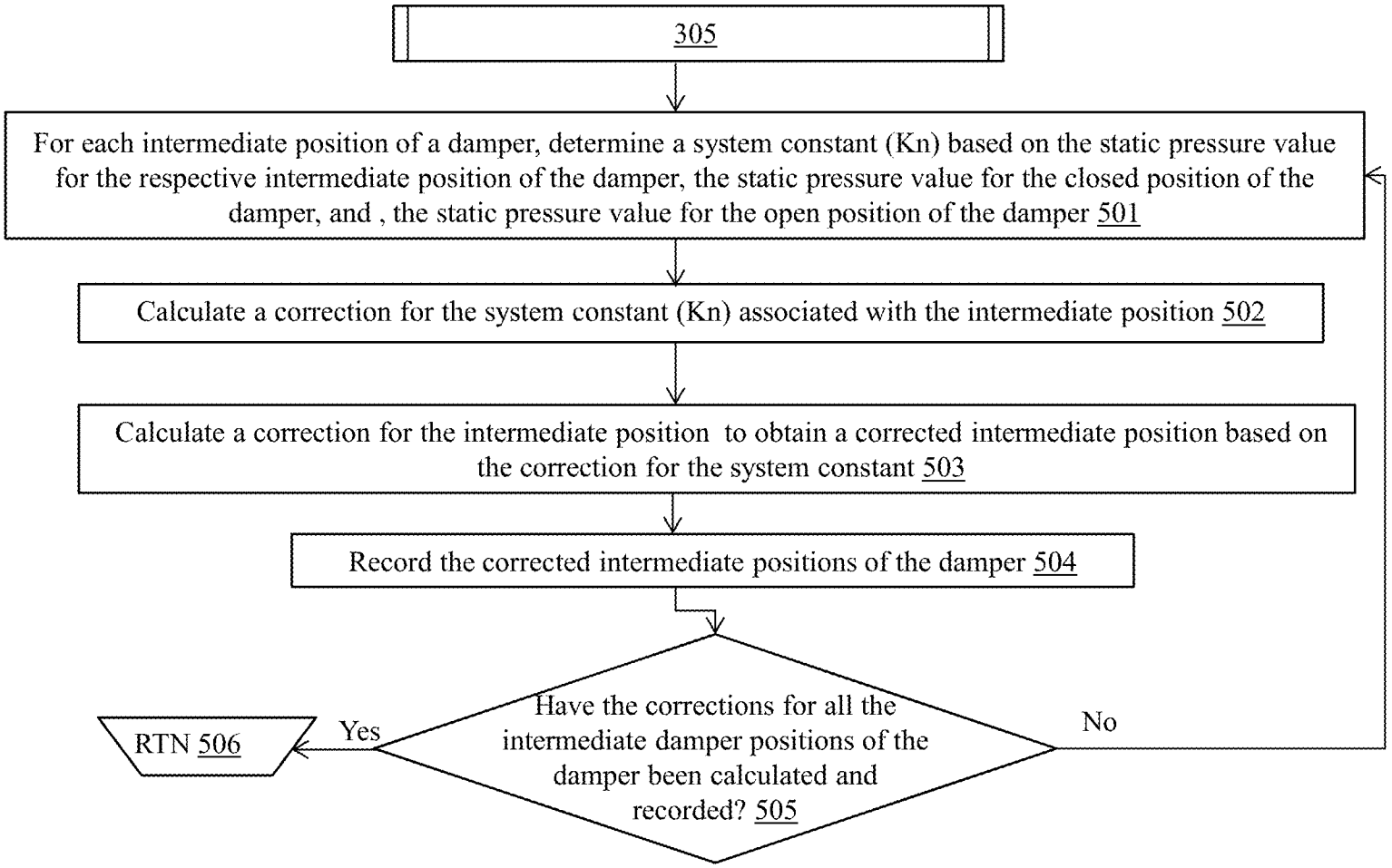
FIG. 5 is a flowchart that illustrates an example method of calculating corrected damper positions for the zone dampers of the HVAC system of FIG. 1 to exhibit a linear behavior of airflow with a change in the damper positions, in accordance with example embodiments of the present disclosure.

Turning to FIG. 5, in step 501, for each intermediate position (hereinafter (position_n) of the damper (102, 102*a*), the system controller 104 calculates a system constant (Kn) based on the recorded values of: (a) the static pressure (SP_position(i)) across the HVAC system 100 when the damper (102, 102*a*) is at the respective position_n, (b) the static pressure (SP_zone closed) across the HVAC system 100 when the damper (102, 102*a*) is in the closed position, and (c) the static pressure (SP_open) across the HVAC system 100 when the damper (102, 102*a*) is in the open position. In particular, the system constant (Kn) for the position_n of the damper (102, 102*a*) is calculated using a mathematical model comprising the following mathematical equation that is derived from the second fan law:

$$Kn = \frac{\left(1 - \sqrt{\frac{SP_{position(n)}}{SP_{zone\ closed}}}\right)}{\left(1 - \sqrt{\frac{SP_{open}}{SP_{zone\ closed}}}\right)}$$

In other words, in step 501, the system controller 104 applies the recorded values of the static pressures, i.e., SP_position(n), SP_open, and SP_zone closed to the above included mathematical model to generate the system constant (Kn) value for the position_n of the damper (102, 102*a*). Then, in step 402, the system controller 104 calculates a correction for the system constant (Kn) associated with position_n of the damper (102, 102*a*).

In an ideal system with a linear behavior, the value of the system constant (Kn_ideal) for each intermediate position of a damper should be equal to a value of the current intermediate position divided by the total number of damper positions of the damper. That is, in an ideal system with a linear behavior, $$Kn_\text{ideal} = (\text{Damper position_}n)/(\text{Total number of damper positions})$$

However, typically, the system constant (Kn) exhibits a nonlinear behavior. Therefore, in step 502, the system controller 104 calculates a correction for the system constant (Kn) associated with the position_n of the damper (102, 102*a*) based on a value of the system constant (Kn_ideal) associated with the position_n in the ideal system, the value of the system constant (Kn) associated with the position_n which is calculated based on the recorded static pressure values, and the value of the system constant ($K_{n+1}$) associated with the next damper position of the damper (102, 102*a*) following the intermediate position_n. In particular, the correction for the system constant (Kn) associated with the position_n of the damper (102, 102*a*) may be expressed as a percentage value and is calculated using the following mathematical equation:

$$\text{Correction } percent_n = \frac{(Kn_{ideal} - K_{n+1})}{(Kn - K_{n+1})}$$

The correction for the system constant associated with the position_n of the damper (102, 102*a*) may adjust for a deviation of the system constant (Kn) from the ideal system constant (Kn_ideal) resulting from the nonlinear behavior.

Responsive to calculating the correction for the system constant associated with position_n of the damper (102, 102*a*), in step 503, the system controller 104 calculates a corrected position_n based on the calculated correction for the system constant (Kn) associated with the position_n of the damper (102, 102*a*). In particular, the corrected position_n corresponding to the position_n of the damper (102, 102*a*) is calculated using the following mathematical equation:

$$\text{Corrected damper position}_n = (\text{Damper position}_n - (1 - \text{Correction percent}_n) * (\text{Damper position}_n - \text{Damper position}_{n+1}))$$

At the corrected damper position, the system may exhibit a linear airflow behavior through the damper (102, 102*a*). Responsive to calculating the corrected position_n corresponding to the position_n of the damper (102, 102*a*), in step 504, the system controller 104 records the corrected position_n of the damper (102, 102*a*). Further, in step 505, the system controller 104 determines whether corrected positions for all the damper positions of the damper (102, 102*a*) have been calculated and recorded. If the corrected positions for all the damper positions of the damper (102, 102*a*) have not been calculated and/or recorded, then, steps 501-504 may be repeated for the remaining damper positions of the damper (102, 102*a*) till corresponding corrected positions for all the damper positions of the damper (102, 102*a*) have been calculated and recorded. Once the corresponding corrected positions for all the damper positions of the damper (102, 102*a*) have been calculated and recorded, the system controller 104 returns to step 306 of step 300.

Returning to FIG. 3, in step 306, the system controller 104 checks whether the corrections for each intermediate position of all the dampers (102, 102*a*) of the HVAC system 100 have been calculated. If the system controller 104 determines that corrected positions for each intermediate position of all the dampers (102, 102*a*) have not been determined, then, steps 304-305 may be repeated for the remaining dampers (102, 102*a*) of the HVAC system 100 till corrected positions for each intermediate position of all the dampers (102, 102*a*) have been determined. After the corrected positions for each damper position of all the dampers (102, 102*a*) have been calculated and recorded, the operation 300 of the system controller 104 associated with the initial set up phase of the HVAC system 100 ends at step 307.

An operational phase or operation 600 of the HVAC system 100 during a demand cycle will be described below in greater detail in association with FIG. 6. It is noted that the operation 600 associated with a demand cycle of the HVAC system 100 may be focused on the intelligent bypass damper operation to bypass air in the HVAC system 100. Accordingly, only steps that are relevant to the intelligent bypass damper operation to bypass air in the HVAC system 100 are disclosed in operation 600. One of ordinary skill in the art can understand and appreciate that in addition to the steps shown in FIG. 6, the demand cycle of the HVAC system 100 may include other additional steps that are not discussed herein to avoid obscuring the intelligent bypass damper operation to bypass air in the HVAC system 100.

Figure 6A:
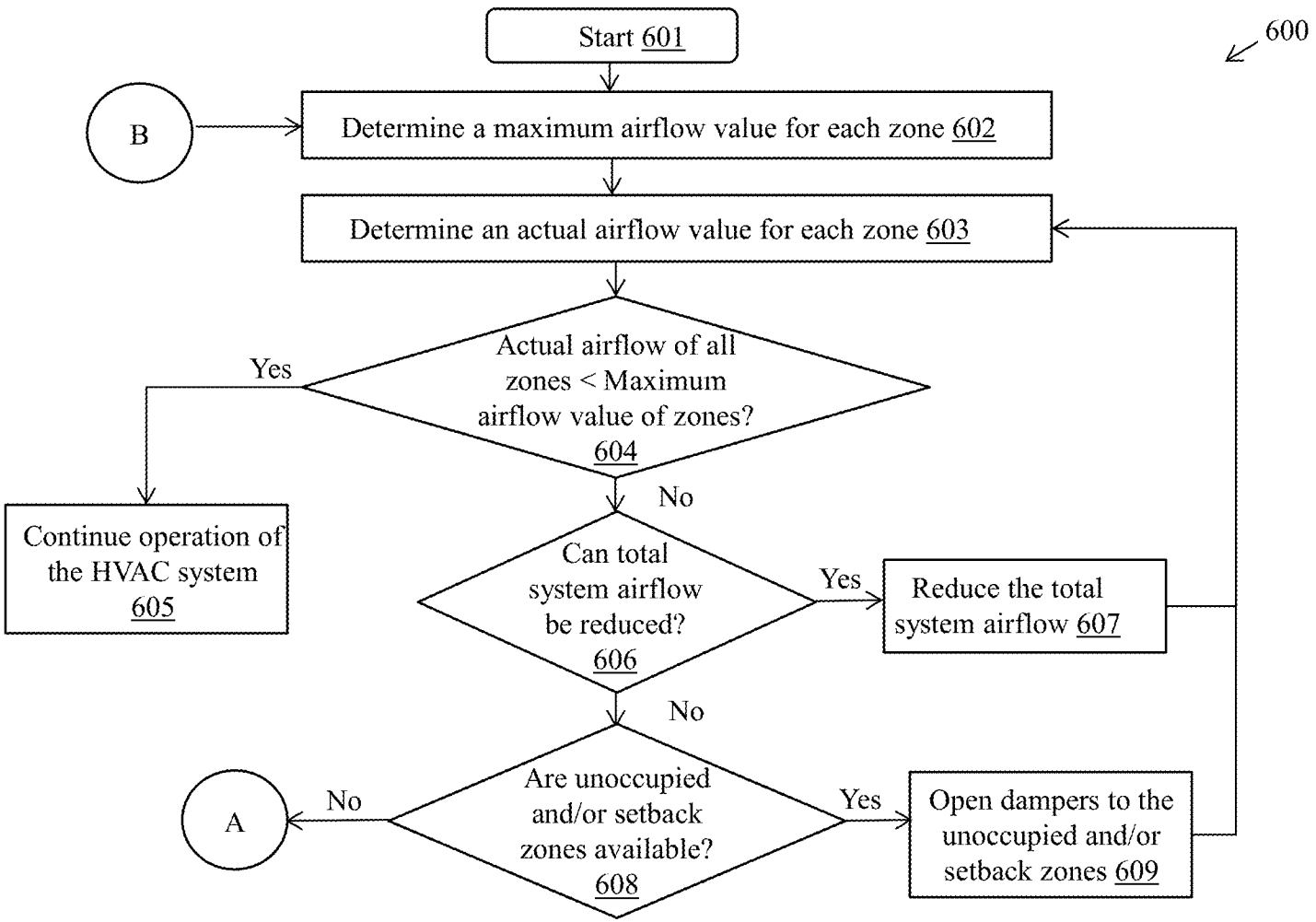
FIGS. 6A-6C (collectively 'FIG. 6') are flowcharts that illustrate an example operation of the HVAC system of FIG. 1 during an operational phase, in accordance with example embodiments of the present disclosure.
Figure 6B:
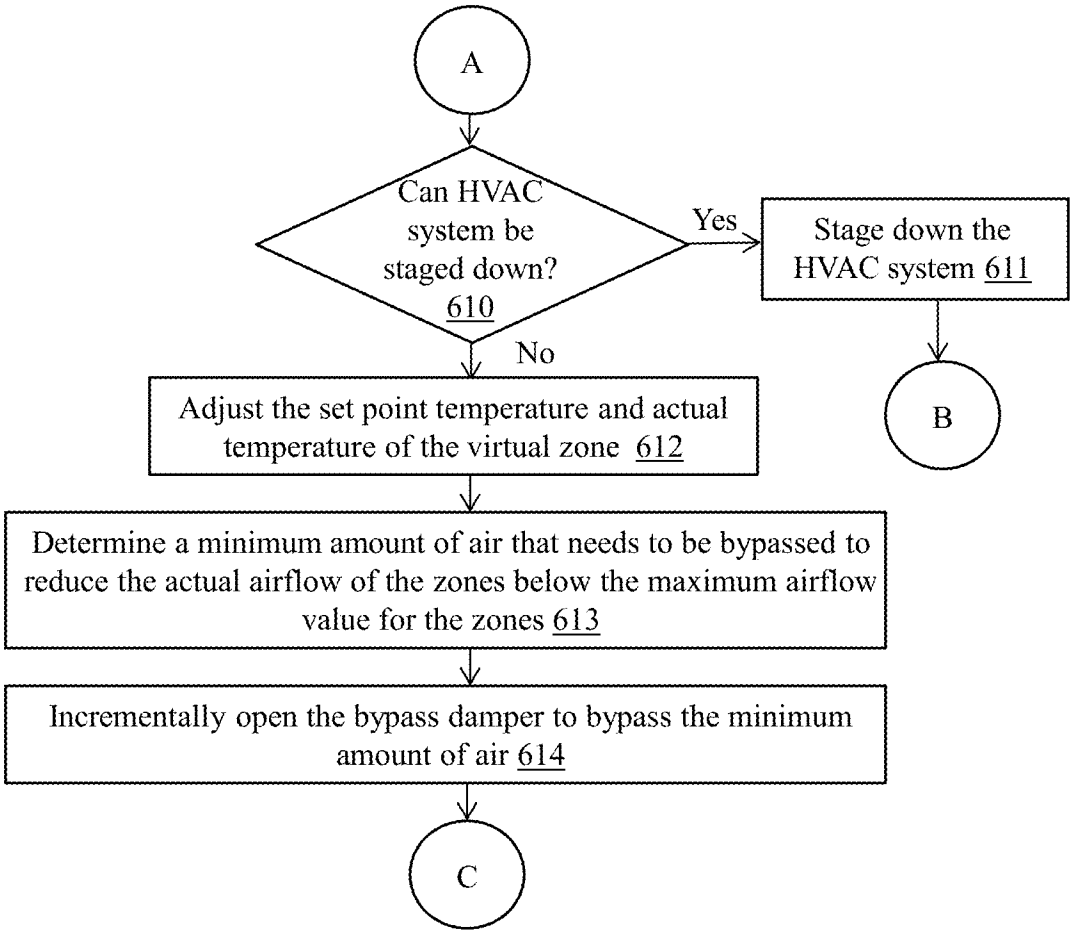
Figure 6C:
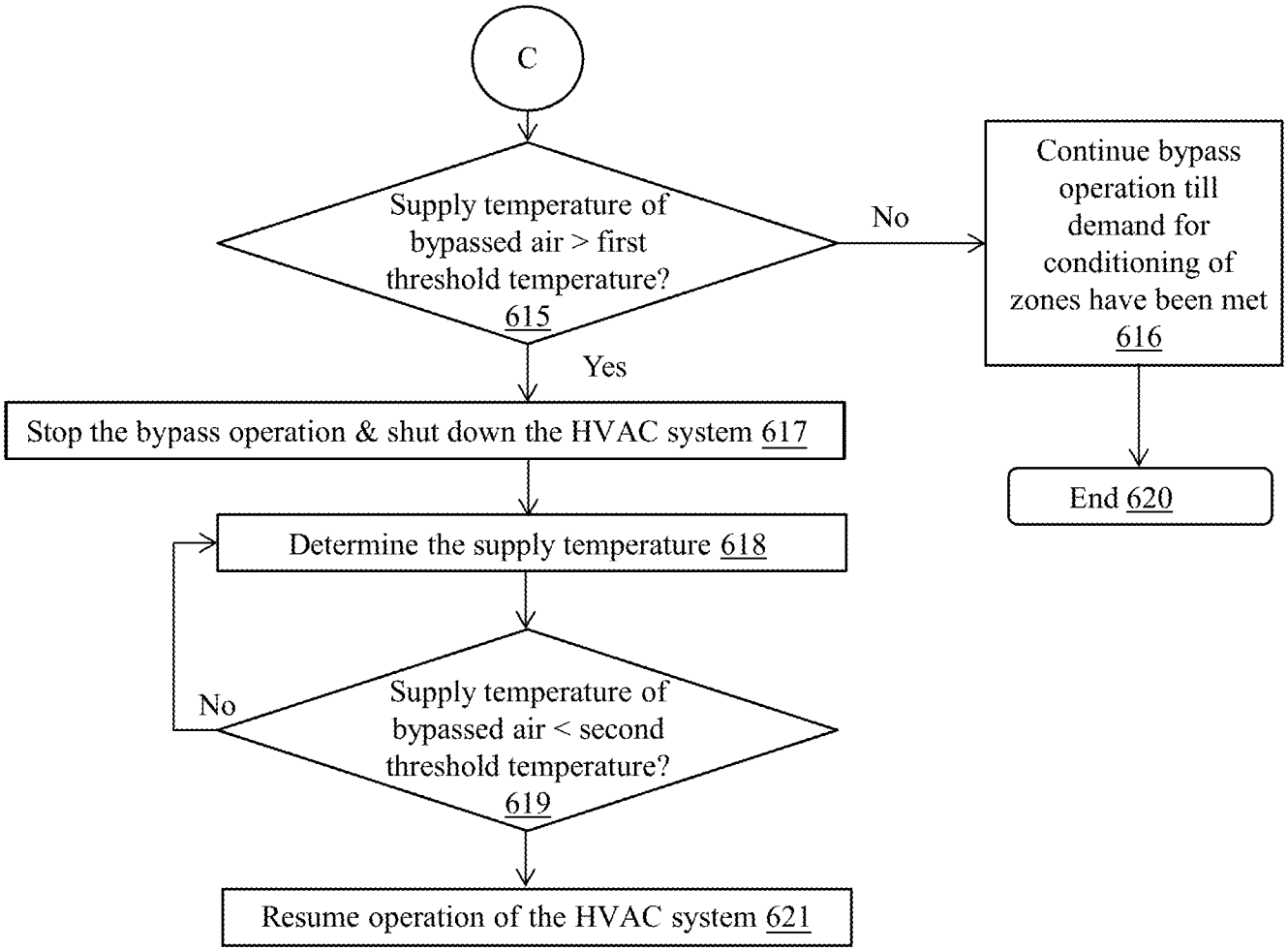

Referring to FIG. 6, operation 600 begins at step 601 and proceeds to step 602 where the system controller 104 determines a maximum airflow value for each of the zones 150 of the HVAC system 100. The system controller 104 may calculate the maximum airflow value for a zone 150 using mathematical models known to one of skill in the art and based on the relative size of the zone 150 that is determined during the initial set up phase as described above in association with FIG. 4, the size and capacity of the HVAC system 100, and a setting associated with an airflow limit for the zone 150. Example airflow limits may include maximum, medium, low, etc. The airflow limits may be selected and set by an installer or an end user based on a desired noise level. For example, an installer may select a low airflow limit to maintain very low noise levels. The maximum airflow value may represent the maximum airflow that is allowed into a zone.

One of ordinary skill in the art can understand and appreciate that in other example embodiments, the maximum airflow value for a zone can be calculated using any other factors and using any other appropriate mechanism without departing from a broader scope of the present disclosure. Further, it is noted that even though the present disclosure describes the calculation of the maximum airflow value as being part of the operational cycle of the HVAC system 100, one of ordinary skill in the art can understand and appreciate that the maximum airflow calculation can be performed in operations associated with the initial set up phase, for example, along with step 409 where the relative size of each zone is calculated.

Once the maximum airflow value for each zone is determined, in step 603, the system controller 104 calculates that an actual airflow value through each of the zones 150 of the HVAC system 100. The actual airflow value through a zone 150 may be calculated based on the damper position of a zone damper 102 of the zone 150, the relative size of the zone 150, and the total system airflow that may either be known or calculated by the system controller 104.

Responsive to determining the actual airflow value through each zone 150, in step 604, the system controller 104 may compare the actual airflow value of each zone 150 to its maximum airflow value. If the actual airflow value of the zones 150 are less than the maximum airflow value of the respective zones 150, then the system controller 104 proceeds to step 605 where the system controller 104 continues the operation of the HVAC system 100.

However, if the actual airflow value of any of the zones exceeds its maximum airflow, then, in step 606, the system controller 104 determines whether the total system airflow of the HVAC system 100 can be reduced by controlling the variable speed blower assembly 112. If the total system airflow can be reduced, then in step 607, the system controller 104 incrementally reduces the total system airflow to a lower limit. Responsively, the system controller 104 returns to step 603 to recalculate the actual airflow value for each zone and move back to step 604 to check if the actual airflow value of any one of the zones 150 exceeds its maximum airflow value.

In step 606, if the system controller 104 determines that the total system airflow cannot be reduced, or has been reduced to its lower limit, then the system controller 104 moves to step 608, where it determines the availability of an unoccupied zone and/or a setback zone. An example unoccupied zone may include rooms that are only used during certain periods of the year and therefore may be kept at a less conditioned temperature to reduce the cost of operating the HVAC system 100. Similarly, an example setback zone may include zones having set point temperatures that are set back farther than a threshold temperature (e.g., 3-4 degrees) from a demanding zone. If the system controller 104 determines that unoccupied zones or setback zones are available, then the system controller 104 proceeds to step 609 where the zone dampers 150 to the unoccupied zones and/or the setback zones are opened to absorb some of the airflow. The system controller 104 may open the zone dampers 150 to the unoccupied zones and/or the setback zones either directly or by adjusting the set point temperatures associated with the unoccupied zones and/or the setback zones. Responsively, the system controller 104 returns to step 603 to recalculate the actual airflow value for each zone and move back to step 604 to check if the actual airflow value of any one of the zones 150 exceeds its maximum airflow value.

In step 608, if the system controller 104 determines that the unoccupied or setback zones are not available and/or the set point temperatures of the unoccupied or setback zones cannot be adjusted, then the system controller 104 proceeds to step 610, and determines whether the HVAC system can be staged down to a lower heating or cooling stage. If the HVAC system 100 can be staged down, then, in step 611, the system controller 104 proceeds to the lower stage. Responsively, the system controller 104 returns to step 603 to recalculate the actual airflow value for each zone and moves back to step 604 to check if the actual airflow value of any one of the zones 150 exceeds its maximum airflow value.

In step 610, if the system controller 104 determines that the HVAC system 100 cannot be staged down, in conventional smart HVAC systems that do not include the bypass 158, the system controller 104 typically shuts down the operation of the HVAC system 100 which in turn leaves one or more zones under-conditioned. However, in the smart HVAC system 100 of the present disclosure that has a bypass 158 installed therein, if the system controller 104 determines that the HVAC system 100 cannot be staged down, the system controller 104 proceeds to step 612 where the set point temperature and actual temperature of the virtual zone associated with the bypass damper 102*a* are adjusted such that the virtual zone will be used as a dump zone. In one example, for a heating cycle, the set point temperature of the virtual zone will be set 2 degrees lower than the set point temperature of the most setback zone of the HVAC system 100, and the actual temperature of the virtual zone may be adjusted or maintained to be 1 degree above the set point temperature of the virtual zone. In other words, the system controller 104 ensures that the virtual zone has the most setback set point temperature, and actual temperature, and will be used as the dump zone. Even though the present disclosure describes the set point temperature and the actual temperature of the virtual zone being set during the operational phase, in other example embodiments, the set point temperature and the actual temperature of the virtual zone may be set during the initial set up phase.

Further, in step 613, the system controller 104 determines the minimum amount of air (conditioned air) that needs to be bypassed through the bypass dampers to the virtual zone for reducing the actual airflow value in the zones below the maximum airflow values for said zones and keep the HVAC system 100 running, instead of shutting down. For example, if the maximum airflow value for a zone is 1550 cfm and the actual airflow value for the zone is 1610 cfm, the system controller determines that the minimum amount of air (conditioned air) that needs to be bypassed to reduce the actual airflow value in the zone below the maximum airflow value and keep the HVAC system 100 running, instead of shutting down, is slightly greater than 60 cfm.

Once the amount of air that needs to be bypassed is determined, in step 614, the system controller 104 incrementally opens the bypass damper 102*a* to a corrected damper position to bypass the amount of air that is determined in step 612. The corrected damper position is selected from a plurality of corrected damper positions of the bypass damper 102*a* based on the amount of air that needs to be bypassed and a relative size of the virtual zone associated with the bypass damper 102*a*. Each corrected damper position of the bypass damper 102*a* may be associated with a specific amount of air that may be passed through the bypass damper 102*a*. For example, a bypass damper 102*a* may have eight corrected damper positions ranging from a fully closed position to a fully open position, where each corrected damper position may be associated with a specific amount of air that may be passed through the bypass damper 102*a*. In said example, if the airflow through the bypass damper for a fully open position of the bypass damper is X cfm, then, at a second corrected damper position the bypass damper 102*a* may allow 12.5% of X cfm to pass through. Similarly, in said example, at a sixth corrected damper position, the bypass damper 102*a* may allow 75% of X cfm to pass through. The corrected damper positions for each damper of the HVAC system 100 including the bypass damper 102*a* is calculated and recorded during the initial set up phase as described above in greater detail in association with FIGS. 3 and 5. The corrected damper positions of the bypass damper 102*a* provide a precise control of the amount of air that is bypassed through the bypass damper.

Further, to prevent the bypassed air from negatively impacting the temperature control elements 114 of the air handler 103, in step 615, the system controller 104 monitors a supply temperature of the air that is bypassed through the bypass damper 102*a* (or temperature of the supply air) and determines whether the supply temperature is greater than a first threshold temperature. The first threshold temperature may be determined by subtracting a first offset value from a maximum supply temperature for safe operation of the HVAC system 100. For example, the HVAC system 100 may trip out when the supply temperature is approximately 180 F. In said example, the first threshold temperature may be set at 160 F which is 20 F below the maximum supply temperature for a safe operation of the HVAC system 100 without tripping out.

In operation 615, if the supply temperature is determined to be less that the first threshold temperature, in step 616, the system controller 104 continues the bypass operation till a demand for conditioning in the zones has been removed and subsequently the operation 600 ends. However, in step 615, if it is determined that the supply temperature exceeds the first threshold temperature, then, the system controller 104 proceeds to step 617 where the bypass operation may be stopped by closing the bypass damper 102*a* and the HVAC system is shut down. In other words, the system controller 104 is configured to stop the bypass operation and shut down the operation of the HVAC system before the supply temperature reaches a temperature at which the HVAC system trips out and is deemed unsafe for operation. In step 618-619, the system controller 104 may monitor the supply temperature and determine whether the conditioned air has cooled and the supply temperature has dropped below a second threshold temperature. The second threshold temperature may be determined by subtracting a second offset value from the maximum supply temperature, where the second offset value may be greater than the first offset value. For example, the HVAC system 100 may trip out when the supply temperature is approximately 180 F. In said example, the second threshold temperature may be set at 150 F which is 30 F below the maximum supply temperature for a safe operation of the HVAC system 100 without tripping out.

In step 619, if the supply temperature drops below the second threshold temperature, the system controller 104 resumes the operation of the HVAC system. In some example embodiments, the bypass operation may also be resumed by proceeding to operations 613-614 where the minimum amount of air (conditioned air) that needs to be bypassed is determined and the bypass damper 102*a* is incrementally opened to bypass said minimum amount of air for reducing the actual airflow value in the zones below the maximum airflow values for said zones and keep the HVAC system 100 running. However, in step 619, if the supply temperature has not dropped below the second threshold temperature, the system controller 104 returns to step 618 where the system controller 104 continues to monitor the supply temperature and waits for the supply temperature to drop below the second threshold temperature. Operation 600 ends when the demand for conditioning of the zones of the HVAC system has been removed.

Figure 7:
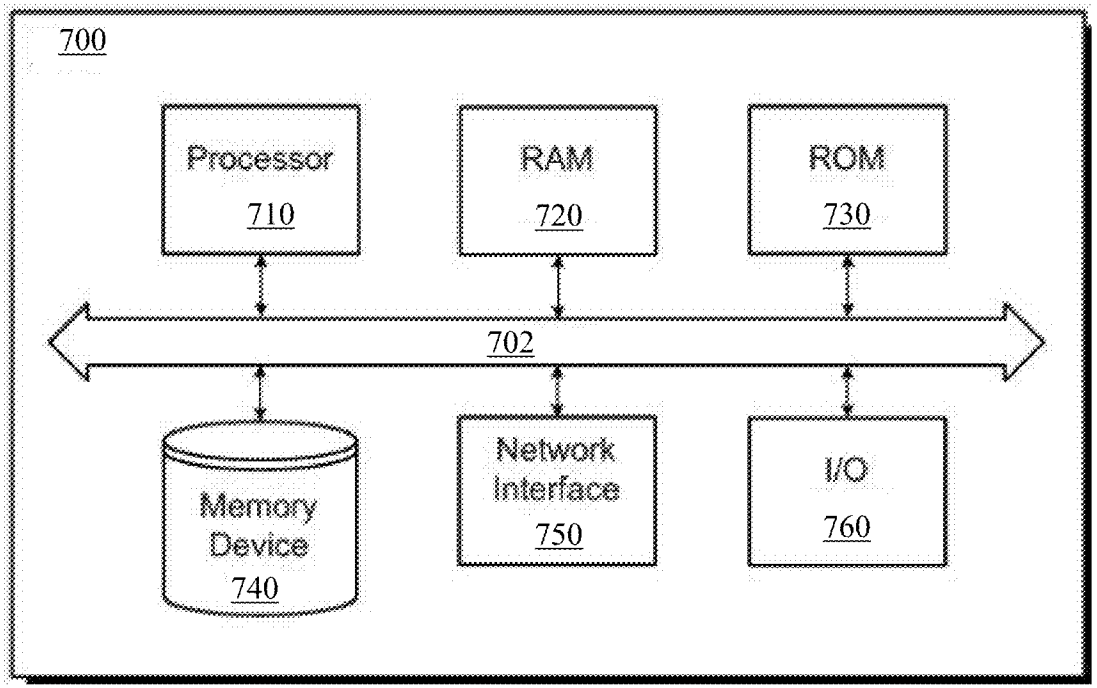
FIG. 7 illustrates a block diagram of an example system controller of the HVAC system, in accordance with example embodiments of the present disclosure.

Turning to FIG. 7, this figure illustrates an example hardware diagram of an example controller 700. The system controller 104 may be implemented using combinations of one or more of the elements of the example controller 700. The example controller 700 includes a processor 710, a Random Access Memory (RAM) 720, a Read Only Memory (ROM) 730, a memory (i.e., storage) device 740, a network interface 750, and an Input Output (I/O) interface 760. The elements of the example controller 700 are communicatively coupled via a bus 702.

The processor 710 comprises any well-known general purpose hardware processor. Both the RAM 720 and the ROM 730 comprise well known random access and read only memory devices, respectively, that store computer-readable instructions to be executed by the processor 710. The memory device 740 stores computer-readable instructions thereon that, when executed by the processor 710, direct the processor 710 to execute various aspects of the present invention described herein. As a non-limiting example group, the memory device 740 may comprise one or more of an optical disc, a magnetic disc, a semiconductor memory (i.e., a flash based memory), a magnetic tape memory, a removable memory, combinations thereof, or any other well-known memory means for storing computer-readable instructions. The I/O interface 760 comprises input and output ports, device input and output interfaces such as a keyboard, pointing device, display, communication, and other interfaces. The bus 702 electrically and communicatively couples the processor 710, the RAM 720, the ROM 730, the memory device 740, the network interface 750, and the I/O interface 760, so that data and instructions may be communicated among the processor 710, the RAM 720, the ROM 730, the memory device 740, the network interface 750, and the I/O interface 760. In operation, the processor 710 is configured to retrieve computer-readable instructions stored on the memory device 740, the ROM 730, or another storage means, and copy the computer-readable instructions to the RAM 720 for execution. The processor 710 is further configured to execute the computer-readable instructions to implement various aspects and features of the present invention described herein.

Although embodiments described herein are made with reference to example embodiments, it should be appreciated by those skilled in the art that various modifications are well within the scope and spirit of this disclosure. Those skilled in the art will appreciate that the example embodiments described herein are not limited to any specifically discussed application and that the embodiments described herein are illustrative and not restrictive. From the description of the example embodiments, equivalents of the elements shown therein will suggest themselves to those skilled in the art, and ways of constructing other embodiments using the present disclosure will suggest themselves to practitioners of the art. Therefore, the scope of the example embodiments is not limited herein.

What is claimed is:

1. An HVAC system comprising:

an air handler that is configured to deliver conditioned air to at least one load zone of a plurality of load zones, a zone damper that is disposed in a supply duct that transports the conditioned air to the at least one load zone, the zone damped being configured to control an airflow of the conditioned air to the at least one load zone;

a bypass damper that is associated with a virtual zone and disposed in a bypass duct that connects the supply duct to a return duct, a system controller that is coupled to the air handler, the zone damper, and the bypass zone damper, wherein the system controller is configured to:

maintain a set point temperature and an actual temperature of the virtual zone such that the virtual zone will be used as a dump zone;

execute an airflow reduction operation comprising at least one of reducing a total system airflow of the HVAC system by controlling a variable speed blower, adjusting setback zones of the HVAC system to dump the conditioned air, and/or staging down a capacity of the HVAC system when the airflow of the conditioned air to the at least one zone exceeds a maximum airflow value for the at least one zone;

control the bypass damper to incrementally bypass a portion of the conditioned air to the virtual zone if the airflow of the conditioned air to the at least one zone exceeds a maximum airflow value for the at least one zone after executing the airflow reduction operation, wherein the portion of the conditioned air that is bypassed is a minimum amount of the conditioned air that is needed to reduce the airflow of the conditioned air to the at least one load zone below the maximum airflow value and keep the HVAC system running; and close the bypass damper when a measured temperature of the portion of the conditioned air that is bypassed from the supply duct exceeds a first threshold temperature.

2. The HVAC system of claim 1, wherein the system controller is configured to:

determine a relative size of the virtual zone using static pressure measurements, wherein the relative size of the virtual zone is representative of a share of a total system airflow that is delivered to the virtual zone when the bypass damper is in a fully open position.

3. An HVAC system comprising:

an air handler that is configured to deliver conditioned air to at least one load zone of a plurality of load zones;

a zone damper that is disposed in a supply duct that transports the conditioned air to the at least one load zone, the zone damped being configured to control an airflow of the conditioned air to the at least one load zone;

a bypass damper that is associated with a virtual zone and disposed in a bypass duct that connects the supply duct to a return duct, a system controller that is coupled to the air handler, the zone damper, and the bypass zone damper, wherein the system controller is configured to:

maintain a set point temperature and an actual temperature of the virtual zone such that the virtual zone will be used as a dump zone;

generate a corrected position for each intermediate damper position of the bypass damper between a fully open position and a fully closed position for obtaining a linear behavior of an airflow of the portion of the conditioned air through the bypass damper, wherein the corrected position for each intermediate damper position of the bypass damper is generated by applying values of static pressure measurements across the HVAC system when the bypass damper is in the fully closed position, in the respective intermediate damper position, and in the fully open position to a mathematical model that is derived from a second fan law;

control the bypass damper to incrementally bypass a portion of the conditioned air to the virtual zone when the airflow of the conditioned air to the at least one zone exceeds a maximum airflow value for the at least one zone, wherein the portion of the conditioned air that is bypassed is a minimum amount of the conditioned air that is needed to reduce the airflow of the conditioned air to the at least one load zone below the maximum airflow value and keep the HVAC system running; and close the bypass damper when a measured temperature of the portion of the conditioned air that is bypassed from the supply duct exceeds a first threshold temperature.

4. An HVAC system comprising:

an air handler that is configured to deliver conditioned air to at least one load zone of a plurality of load zones;

a zone damper that is disposed in a supply duct that transports the conditioned air to the at least one load zone, the zone damped being configured to control an airflow of the conditioned air to the at least one load zone;

a bypass damper that is associated with a virtual zone and disposed in a bypass duct that connects the supply duct to a return duct, a system controller that is coupled to the air handler, the zone damper, and the bypass zone damper, wherein the system controller is configured to:

maintain a set point temperature and an actual temperature of the virtual zone such that the virtual zone will be used as a dump zone;

control the bypass damper to incrementally bypass a portion of the conditioned air to the virtual zone when the airflow of the conditioned air to the at least one zone exceeds a maximum airflow value for the at least one zone, wherein the portion of the conditioned air that is bypassed is a minimum amount of the conditioned air that is needed to reduce the airflow of the conditioned air to the at least one load zone below the maximum airflow value and keep the HVAC system running, wherein to control the bypass damper to incrementally bypass the portion of the conditioned air from the plenum to the virtual zone, the system controller is configured to adjust a damper position of the bypass damper to one of a plurality of corrected damper positions at which an airflow of the portion of the conditioned air through the bypass damper exhibits a linear behavior, wherein the one of the plurality of corrected damper positions is selected based on the minimum amount of the conditioned air that is to be bypassed to the virtual zone and a relative size of the virtual zone, wherein each corrected damper position of the plurality of corrected damper positions is calculated for a corresponding intermediate damper position of the bypass damper between a fully open position and a fully closed position, and wherein the corrected damper position for the corresponding intermediate damper position of the bypass damper is generated by applying values of static pressure measurements across the HVAC system when the bypass damper is in the fully closed position, in the intermediate damper position, and in the fully open position to a mathematical model that is derived from a second fan law; and close the bypass damper when a measured temperature of the portion of the conditioned air that is bypassed from the supply duct exceeds a first threshold temperature.

5. An HVAC system comprising:

an air handler that is configured to deliver conditioned air to at least one load zone of a plurality of load zones;

a zone damper that is disposed in a supply duct that transports the conditioned air to the at least one load zone, the zone damped being configured to control an airflow of the conditioned air to the at least one load zone;

a bypass damper that is associated with a virtual zone and disposed in a bypass duct that connects the supply duct to a return duct, a system controller that is coupled to the air handler, the zone damper, and the bypass zone damper, wherein the system controller is configured to:

maintain a set point temperature and an actual temperature of the virtual zone such that the virtual zone will be used as a dump zone, wherein to maintain the set point temperature and the actual temperature of the virtual zone such that the virtual zone will be used as the dump zone, the system controller is configured to:

adjust the set point temperature of the virtual zone to be a farthest setback set point temperature compared to set point temperatures of the plurality of load zones of the HVAC system; and adjust the actual temperature of the virtual zone to be a farthest setback actual temperature compared actual temperatures of the plurality of load zones of the HVAC system, and maintain the actual temperature of the virtual zone such that the actual temperature does not exceed the set point temperature of the virtual zone;

control the bypass damper to incrementally bypass a portion of the conditioned air to the virtual zone when the airflow of the conditioned air to the at least one zone exceeds a maximum airflow value for the at least one zone, wherein the portion of the conditioned air that is bypassed is a minimum amount of the conditioned air that is needed to reduce the airflow of the conditioned air to the at least one load zone below the maximum airflow value and keep the HVAC system running; and close the bypass damper when a measured temperature of the portion of the conditioned air that is bypassed from the supply duct exceeds a first threshold temperature.

6. The HVAC system of claim 1, wherein the bypass damper is incrementally re-opened to bypass the portion of the conditioned air to the virtual zone when the measured temperature of the portion of the conditioned air that is bypassed is below a second threshold temperature.

7. An HVAC system comprising:

an air handler that is configured to deliver conditioned air to at least one load zone of a plurality of load zones;

a zone damper that is disposed in a supply duct that transports the conditioned air to the at least one load zone, the zone damped being configured to control an airflow of the conditioned air to the at least one load zone;

a bypass damper that is associated with a virtual zone and disposed in a bypass duct that connects the supply duct to a return duct, a system controller that is coupled to the air handler, the zone damper, and the bypass zone damper, wherein the system controller is configured to:

maintain a set point temperature and an actual temperature of the virtual zone such that the virtual zone will be used as a dump zone;

control the bypass damper to incrementally bypass a portion of the conditioned air to the virtual zone when the airflow of the conditioned air to the at least one zone exceeds a maximum airflow value for the at least one zone, wherein the portion of the conditioned air that is bypassed is a minimum amount of the conditioned air that is needed to reduce the airflow of the conditioned air to the at least one load zone below the maximum airflow value and keep the HVAC system running; and close the bypass damper when a measured temperature of the portion of the conditioned air that is bypassed from the supply duct exceeds a first threshold temperature, wherein the bypass damper is incrementally re-opened to bypass the portion of the conditioned air to the virtual zone when the measured temperature of the portion of the conditioned air that is bypassed is below a second threshold temperature, and wherein the first threshold temperature is greater than the second threshold temperature.

8. The HVAC system of claim 6, wherein the first threshold temperature is equal to a first temperature value that is offset below a maximum allowable temperature for a safe operation of the HVAC system by a first value, and the second threshold temperature is equal to a second temperature value that is offset below the maximum allowable temperature for the safe operation of the HVAC system by a second value, and wherein the second value is larger than the first value.

9. The HVAC system of claim 1, wherein the system controller is a thermostat associated with the at least one load zone.

10. The HVAC system of claim 1, wherein the first temperature threshold is selected such that the bypass damper is closed before the HVAC system reaches an unsafe and unstable operating condition.

* * * * *